US007513509B2

(12) United States Patent
Guyot et al.

(10) Patent No.: US 7,513,509 B2
(45) Date of Patent: Apr. 7, 2009

(54) DEVICE FOR MOUNTING COMPONENTS OF A SAFETY BINDING ON A SKI

(75) Inventors: Philippe Guyot, Chedde (FR); Bernard Bayle, Domancy (FR); Olivier Perrin, Passy (FR); Christophe Gerossier, Sallanches (FR)

(73) Assignee: Skis Dynaster, Sallanches (FR)

( * ) Notice: Subject to any disclaimer, the term of this patent is extended or adjusted under 35 U.S.C. 154(b) by 550 days.

(21) Appl. No.: 11/271,958

(22) Filed: Nov. 14, 2005

(65) Prior Publication Data

US 2006/0103113 A1 May 18, 2006

(30) Foreign Application Priority Data

Nov. 12, 2004 (FR) ..... 04 52602

(51) Int. Cl.
*A63C 9/00* (2006.01)

(52) U.S. Cl. ..... 280/11.14; 280/611

(58) Field of Classification Search ..... 280/601, 280/602, 607, 11.14, 617, 618, 620, 633, 280/634, 636
See application file for complete search history.

(56) References Cited

U.S. PATENT DOCUMENTS

| | | | | |
|---|---|---|---|---|
| 5,135,250 | A | 8/1992 | Abondance et al. | |
| 5,671,940 | A * | 9/1997 | Abondance | 280/602 |
| 5,785,342 | A * | 7/1998 | Bronson | 280/602 |
| 6,412,807 | B1 * | 7/2002 | Arduin et al. | 280/607 |
| 7,284,767 | B2 * | 10/2007 | Himmetsberger et al. | 280/617 |
| 2002/0047250 | A1 | 4/2002 | Luitz et al. | |
| 2002/0105167 | A1 | 8/2002 | Mercier et al. | |
| 2002/0130490 | A1 | 9/2002 | Billon et al. | |

FOREIGN PATENT DOCUMENTS

| | | | |
|---|---|---|---|
| EP | 0 409 749 | A1 | 1/1991 |
| FR | 2 664 823 | A1 | 1/1992 |
| FR | 2 695 041 | A1 | 3/1994 |
| FR | 2 713 101 | A1 | 6/1995 |
| FR | 2 731 358 | A1 | 9/1996 |
| FR | 2 809 634 | A1 | 12/2001 |
| FR | 2 820 335 | A1 | 8/2002 |

* cited by examiner

*Primary Examiner*—Christopher P Ellis
*Assistant Examiner*—Vaughn T Coolman
(74) *Attorney, Agent, or Firm*—Browdy and Neimark, P.L.L.C.

(57) ABSTRACT

A device (1) for mounting the components of a safety binding on a ski (2), comprising:

a rigid platform (3) that extends over the entire length of the area in which the binding is mounted and comprises lateral slides (12);

an elastomer element (4) that extends under the rigid platform (3) and is intended to come into contact with the upper surface of the ski (2);

two limit stops (6) and (5), front and back respectively, that cooperate with the rigid platform (3) in order to restrict its longitudinal displacement;

a rear plate (7) capable of accommodating the heel piece of the binding, said rear plate (7) being mechanically linked to the rigid platform (3) and secured on the board through retention elements (42, 44) that are directly fixed on the ski either side of the rigid platform (3).

9 Claims, 3 Drawing Sheets

DEVICE FOR MOUNTING COMPONENTS OF A SAFETY BINDING ON A SKI

TECHNICAL FIELD

The invention relates to the field of snow boardsports and, more particularly, Alpine skiing. More precisely, it concerns a device for mounting components of a safety binding on a ski, namely the heel piece and the toe piece.

DESCRIPTION OF THE PRIOR ART

Generally speaking, very many solutions have already been proposed to make it possible to mount the components of the binding not directly on the upper surface of the ski but on an intermediate device. This type of intermediate device may be used for several reasons. In the case of skis that are intended for hire, it is useful if the bindings have a longitudinal adjustment facility and the use of an intermediate device makes it possible to avoid having to drill many holes in the upper surface of the ski. Such an adjustment facility is described, in particular, in document FR 2 820 335.

Intermediate devices also make it possible to raise the binding and make it easier to roll from one edge to the other as described in document EP 0 409 749.

From a mechanical point of view, these intermediate devices are also used to ensure loose linkage, i.e. to limit the effect of the stiffness of the sole of the boot on the behaviour of the ski.

The loose linkage phenomenon is relatively complex because there is a need to ensure good anchorage of the components of the binding without modifying the inherent stiffness of the board excessively. This is why solutions have been suggested whereby a plate of viscoelastic material is placed underneath the platform as illustrated in document FR 2 664 823.

In other solutions, especially that described in document FR 2 809 634, part of the platform may be made mobile relative to the upper surface of the ski by being mounted with the ability to slide relative to a fixed point attached to the upper surface of the ski.

SUMMARY OF THE INVENTION

The invention therefore relates to a device for mounting the components of a safety binding on a ski.

In accordance with the invention, this device comprises:

- a rigid platform that extends over the entire length of the area in which the binding is mounted and comprises lateral slides;
- an elastomer element that extends under the rigid platform and is intended to come into contact with the upper surface of the ski;
- two limit stops, front and back respectively, that cooperate with the rigid platform in order to restrict its longitudinal displacement;
- a rear plate capable of accommodating the heel piece of the binding, said rear plate being mechanically linked to the rigid platform and secured on the ski through retention elements that are directly fixed on the ski either side of the rigid platform.

The heel piece of the binding is mounted on the rear plate which in turn rests on the upper surface of the platform by sitting astride it crosswise therefore allowing the platform/rear plate assembly to move longitudinally relative to the ski.

This movement is nevertheless limited by the presence of limit stops, especially the rear limit stop, which prevents excessive backward sliding of the platform.

In practice, this rear plate may comprise parts that extend downwards on either side of the platform and are intended to almost come into contact with the upper surface of the ski. These distinctive parts define, relative to each other, a channel inside which the rigid platform is fitted.

Advantageously and in practice, the rigid platform may have lateral recesses that interrupt the slides so as to leave room for the parts of the rear plate that extend downwards and that almost come into contact with the upper surface of the ski. These recesses therefore make it possible to fit this rear plate on top of the platform whilst allowing longitudinal movement of the rear plate relative to the retention elements.

In practice, the toe piece of the binding can be attached either directly to the rigid platform or, advantageously, to a front plate attached to the rigid platform by fittings provided for this purpose.

In one particular embodiment, this front plate may be made capable of sliding relative to the rigid platform in order to allow attachment to the platform in different longitudinal adjustment positions. In this way, the position of the toe piece is adjusted by moving the front plate and locking it on the platform in the desired position.

This front plate may advantageously come into contact with the upper surface of the ski by sitting astride the rigid platform crosswise so as to transmit the thrust exerted on the toe piece to the board. This overcomes the damping effect produced by the elastomer element located underneath the rigid platform.

This elastomer element may advantageously have a prominent area located between the rear end of the rigid platform and the rear limit stop.

This area that extends between the fixed point of the rear limit stop and the platform produces a damping effect during movement of the rigid platform due to arching of the ski.

In order not to increase the overall stiffness of the ski when fitted with a binding too much, the platform may advantageously have a tubular structure that defines longitudinal channels in order to retain good torsional stiffness whilst limiting overall weight.

Similarly, the central part of the platform may have transverse notches made on its lower surface intended to reduce its flexural stiffness.

BRIEF DESCRIPTION OF THE DRAWINGS

The way in which the invention is implemented and its resulting advantages will become apparent from the description of the following embodiment, given merely by way of example, reference being made to the accompanying drawings in which.

DESCRIPTION OF THE PREFERRED EMBODIMENTS

Figure 1:
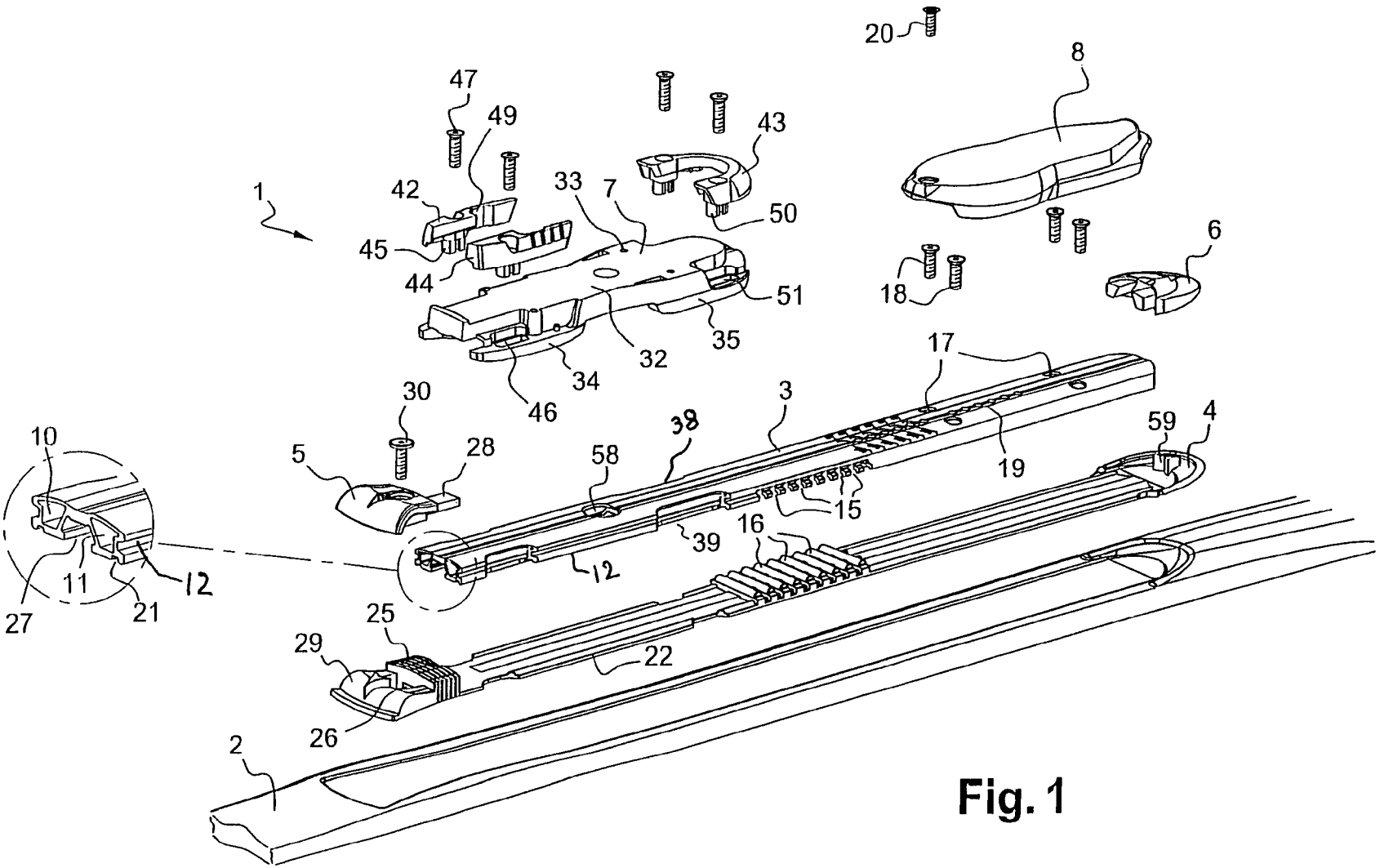
FIG. 1 is an exploded perspective view of a device according to the invention.
Figure 2:
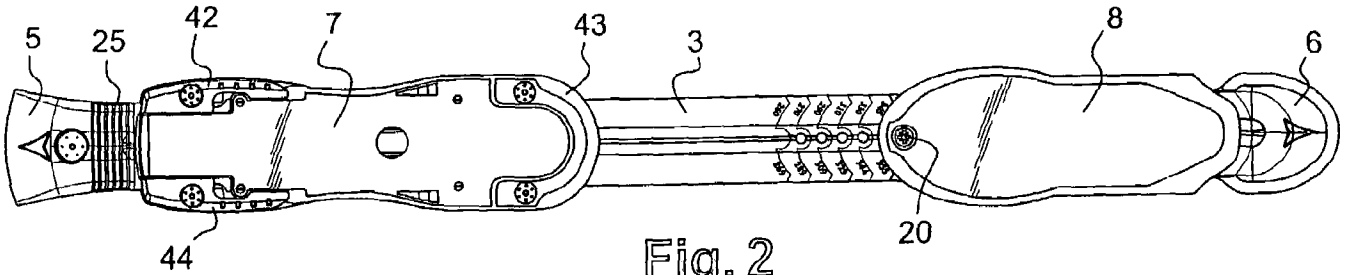
FIGS. 2, 3 and 4 are top, side and bottom views respectively of the devices shown in FIG. 1 in an assembled configuration.
Figure 3:
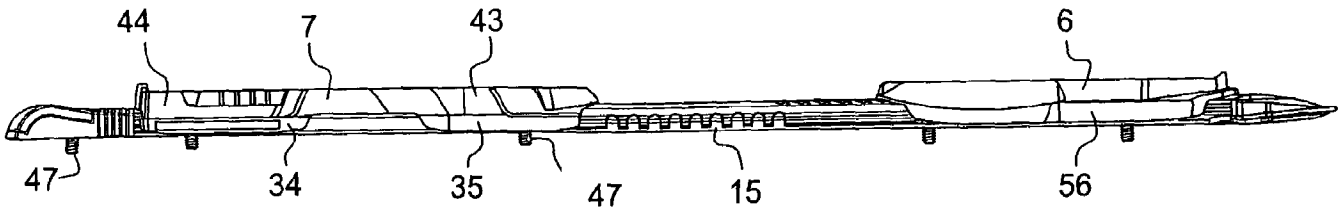
Figure 4:
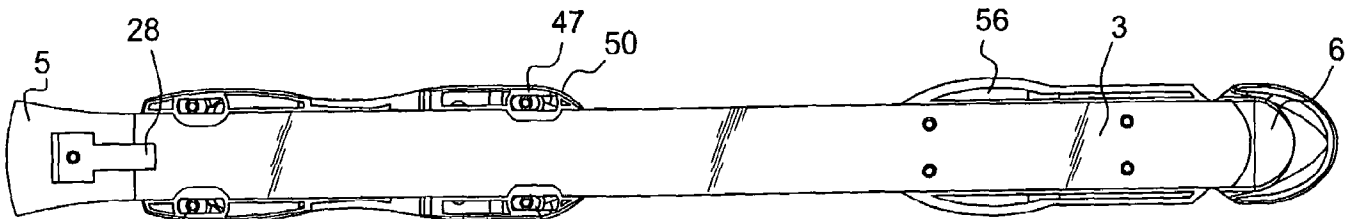
Figure 5:
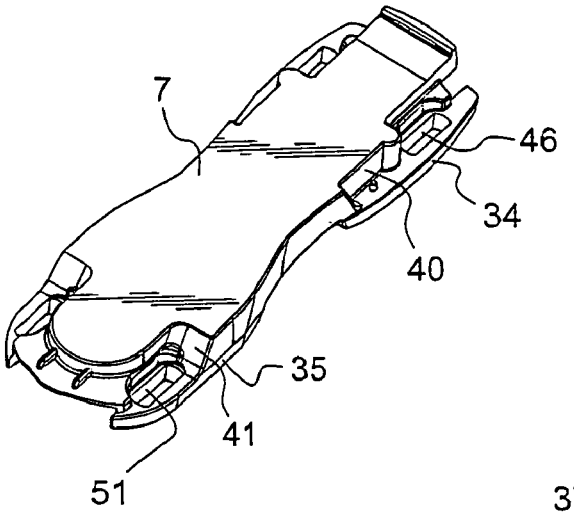
FIGS. 5 and 6 are three-quarter perspective front views of the top and bottom of the rear plate respectively.

FIG. 1 shows the entire device (1) intended to ensure mounting of the components of the binding (not shown) on the ski (2). More precisely, the mounting device (1) comprises a rigid platform (3) which rests on a viscoelastic part (4) which itself rests on the upper surface of the ski (2).

The front (6) and rear (5) limit stops cooperate with the ends of the rigid platform (3). The upper surface of this rigid platform accommodates a rear plate (7) intended to accommodate the heel piece (not shown) and a front plate (8) is provided to accommodate the toe piece (not shown) of the binding.

More precisely, it can be seen in FIG. 1 that the rigid platform (3) has a tubular structure and channels (10, 11) that extend over the entire length of the platform and therefore make it possible to produce the latter from a single section. This section can be made of metal, for instance an aluminium-based alloy such as Zicral® or even a material based on fibre-filled plastic.

Platform (3) has two lateral slides formed by a groove (12) that extends longitudinally along the side of platform (3).

In versions that are not shown, the slides may be obtained differently, especially by restricting the width of the platform defining a rail that is capable of accommodating the prominent areas of the unit intended to slide on the platform.

The middle part of the platform (3) has notches (15) intended to reduce the flexural stiffness of the rigid platform (3). These notches are made by machining the section that forms platform (3). These notches (15) are intended to be filled by ridges (16) on the upper surface of elastomer part (4). These ridges (16) are intended to be compressed during flexing movements of platform (3) and provide damping or resilience, depending on the material used.

The front part of platform (3) has drilled holes (17) that accommodate mounting screws (18) on the upper surface of the board. Platform (3) also has a plurality of central holes (19) intended to accommodate the lock screw (20) of front plate (8).

A plurality of holes (19) makes it possible to adjust the longitudinal position of front plate (8) depending on the length of the boot.

On its lower surface, rigid platform (3) has grooves (21), arranged laterally and intended to accommodate ribs (22) formed on the upper surface of the elastomer layer (4).

These ribs make it possible, in particular, to limit the penetration of snow and water and, above all, prevent sideways escape of the elastomer layer (4). These ribs (22) also constitute a compressible area that is capable of providing a damping effect.

The rear part of elastomer layer (4) has a bulge (25), the front surface of which is intended to accommodate the support points and rear ends of platform (3). This bulge (25) is longitudinally pierced by an opening (26) intended to accommodate a forward-pointing part (28) of rear limit stop (5). When limit stop (5) is fitted on the rear end (29) of elastomer layer (4), this part (28) passes through opening (26) and penetrates inside central channel (27) of rigid platform (3). This prevents lateral displacement of the platform.

Longitudinal displacement of the platform is limited by compression of prominent area (25) between the rear end of platform (3) and the rear limit stop (5) which is itself connected to the upper surface of the ski by screw (30).

In fact, the rear part of platform (3) has the ability to move longitudinally thanks to the architecture of the rear plate (7).

More precisely, this rear plate (7) has an upper surface (32) intended to accommodate the heel piece through the screw fasteners in holes (33).

Figure 6:
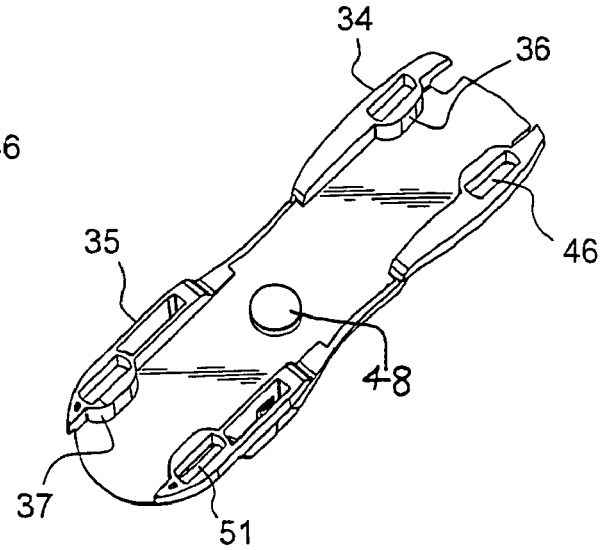
Figure 7:
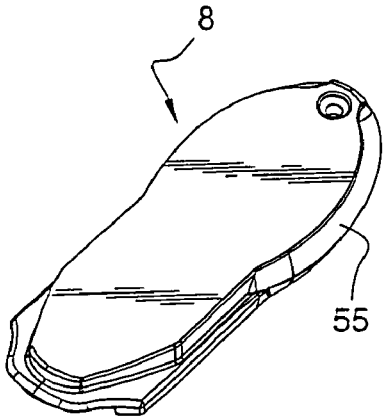
FIGS. 7 and 8 are three-quarter perspective front views of the top and bottom of the front plate respectively.

The rear plate (7) has, on its lower surface, areas that extend downwards (34, 35) so that they almost come into contact with the upper surface of the ski (2). In this way slight clearance is left between the rear plate and the upper surface of the ski with a view to preventing excessive friction during arching of the ski. Between the two sides of rear plate (7), these areas (34, 35) define a gap inside which platform (3) fits. As shown in FIG. 6, the internal surfaces of these areas (34, 35) have bulges (36, 37) intended to fit into recesses (38, 39) made on the sides of rigid platform (3).

In this way, the rear plate is attached to the platform for longitudinal movements. This locking is supplemented by the presence of prominent stud (48) on the lower surface of the rear plate which fits inside the receptacle (58) on the upper surface of the rigid platform.

Above areas (34, 35) extending downwards, rear plate (7) has recesses (40, 41) that accommodate matching parts (42, 44). Parts (42, 44) arranged behind plate (7) have in their lower part a bush (45) capable of accommodating fixing screws (47). This bush (45) penetrates inside a recess (46), the longitudinal dimensions of which are greater so that rear plate (7) can move longitudinally relative to the fixed point provided by mounting screw (47) due to the effect of displacement of platform (3).

The shapes of fasteners (42, 44), especially recess (49), are designed to allow this longitudinal displacement. Similarly, bushes (50) of matching part (43) have a length in the longitudinal direction that is less than that of recess (51) that accommodates them.

In the front part, the device according to the invention has a limit stop (6) that shuts off channels (10, 11) of platform (3) and constitutes a trim that rests on the front of elastomer layer (4).

This limit stop (6) is held in position by being fitted on a prominent area (59) of elastomer layer (4).

Figure 8:
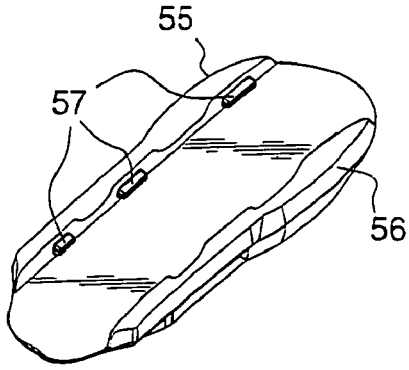

As shown in FIG. 8, front plate (8) has lateral areas (55, 56) that extend vertically and continue in contact with the upper surface of the board.

These lateral areas (55, 56) have, on their inside surface, guides (57) intended to cooperate with slide (12) of rigid platform (3) during adjustment of the longitudinal position of the front plate on said platform (3).

During use, rigid platform (3) is securely fixed by its front end to the upper surface of the ski (2). The rear part of the platform slides relative to the upper surface of the ski. In fact, rear plate (7) has the ability to slide longitudinally relative to the fixed point provided by mounting screws (47) thanks to the elongated shape of recesses (46). As a result, during arching, the rear plate is slightly offset to the rear by movement of the platform, the deformation of which is markedly less than that of the ski.

The performance of skis fitted with the invention is significantly improved. In fact, it has been observed that, thanks to displacement of the rear plate/platform assembly, the ski deforms better in order to carve into the curve of the turn. Adhesion and pressure at the sidecuts are thereby increased, regardless of the type of turn.

The invention claimed is:

1. A device (1) for mounting the components of a safety binding on a ski (2), comprising:

a rigid platform (3) that extends over the entire length of the area in which the binding is mounted and comprises lateral slides (12);

an elastomer element (4) that extends under the rigid platform (3) and is intended to come into contact with the upper surface of the ski (2);

two limit stops (6) and (5), front and back respectively, that cooperate with the rigid platform (3) in order to restrict its longitudinal displacement;

a rear plate (7) capable of accommodating the heel piece of the binding, said rear plate (7) being mechanically linked to the rigid platform (3) and secured on the ski (2) through retention elements that are directly fixed on the ski either side of the rigid platform (3);

wherein the rear plate (7) has parts (34, 35) that extend downwards on either side of the platform and are intended to almost come into contact with the upper surface of the ski (2).

2. The device as claimed in claim 1, wherein the rigid platform (3) has lateral recesses (38, 39) that interrupt the slides (12) so as to leave room for the parts (34, 35) of the rear plate that extend downwards in order to fit said rear plate (7) on top of the platform (3).

3. The device as claimed in claim 1, wherein the retention elements (42, 44) pass through openings in the rear plate which allow longitudinal movement of the rear plate relative to the retention elements.

4. The device as claimed in claim 1, wherein the element (4) made of an elastomer material has a prominent area (25) located between the rear end of the rigid platform (3) and the rear limit stop (5).

5. The device as claimed in claim 1, wherein the rigid platform (3) has a tubular structure.

6. The device as claimed in claim 1, wherein a middle part of platform (3) has transverse notches (15).

7. The device as claimed in claim 1, further comprising a front plate (8) capable of accommodating the toe piece of the binding and fittings (20) capable of attaching the front plate (8) to the rigid platform (3).

8. The device as claimed in claim 7, wherein the front plate (8) is capable of sliding relative to rigid platform (3) in order to allow it to be attached to the rigid platform in different longitudinal position adjustments.

9. The device as claimed in claim 7, wherein the front plate (8) comes into contact with the upper surface of the ski (2) by sitting astride rigid platform (3) crosswise.

* * * * *